United States Patent [19]

Ishida et al.

[11] Patent Number: 4,839,992

[45] Date of Patent: Jun. 20, 1989

[54] POLISHING DEVICE

[75] Inventors: Takeo Ishida, Aichi; Hiroshi Hagiwara; Ichizo Kakumu, both of Nagoya, all of Japan

[73] Assignee: Sintobrator, Ltd., Nagoya, Japan

[21] Appl. No.: 177,268

[22] Filed: Apr. 4, 1988

[30] Foreign Application Priority Data

Dec. 22, 1987 [JP] Japan ..... 62-324816
Dec. 22, 1987 [JP] Japan ..... 62-324817
Dec. 22, 1987 [JP] Japan ..... 62-194346[U]

[51] Int. Cl.[4] ..... B24B 7/00
[52] U.S. Cl. ..... 51/5 D; 51/123 R; 51/131.4
[58] Field of Search ..... 51/5 D, 109 R, 121, 51/122, 165.77, 165.85, 209 D, 209 DL, 327, 325, 131.1–131.4, 129, 165.87; 125/11 R, 11 DF

[56] References Cited

U.S. PATENT DOCUMENTS 2,079,076 5/1937 Kranich ..... 51/131.3
3,968,598 7/1976 Ogawa ..... 51/131.4

*Primary Examiner*—Frederick R. Schmidt
*Assistant Examiner*—Maurina Rachuba
*Attorney, Agent, or Firm*—Armstrong, Nikaido Marmelstein Kubovcik & Murray

[57] ABSTRACT

On a frame, a rotary grindstone is rotatably provided in such a manner that the upper surface of the rotary grindstone serves as a grinding side and a workpiece holding device which holds a workpiece and abuts the workpiece against the grinding side of the rotary grindstone is provided. Furthermore, a truing dressing device is provided on the frame, the truing dressing device bringing a rotary grindstone for truing dressing into contact with the grinding side of the rotary grindstone for the purpose of conducting truing dressing the grinding side of the rotary grindstone with retaining grinding conducted by means of the rotary grindstone.

4 Claims, 5 Drawing Sheets

POLISHING DEVICE

BACKGROUND OF THE INVENTION

1. Field of the Invention

This invention relates to a device for polishing flat surfaces of metallic parts and ceramic parts.

2. Description of the Prior Art

In order to polish the flat surfaces of metailic parts and the like, a lapping method is often employed in which "Alundum" or "Carborundum" works in the form of free grains, and another lapping method is often employed in which the above abrasive grains are fixed to a lapping disc by way of embedding or the like. Furthermore, a polishing method is often employed in which a surface abrading disc is used.

However, in these conventional lapping systems in which free grains or fixed grains are employed, so many problems are experienced because dust generates, workpieces must be washed, loading of the fixed grains occurs, the precision of the parts being machined deteriorates due to offset wear, and manufacturing efficiency is also adversely affected. In conventional polishing systems, many problems also arise since the accuracy of the polishing machine and that of the grindstone affect the dimensional precision of the workpiece which is being polished, and an expensive device of precise specification is needed in order to accurately polish the workpiece. Furthermore, the truing dressing of the grindstone must be treated with great care. Additionally, since the truing dressing is conducted by replacing a grindstone on an exclusive device, it involves much labor and time, and the working rate of the polishing device suffers. Furthermore, in order to obtain a finished surface of predetermined accuracy, the roughness of the grindstone must be changed. Consequently many problems arise in that it is difficult to automate polishing work as a whole, to reduce running costs, or to increase working efficiency and yields.

In the method in which a surface abrading disc is employed, since both the workpiece and the grindstone are firmly fixed, the precision of the finished workpiece corresponds to the accuracy of the machine per se and this results in the use of expensive machinery. Furthermore, a finished surface cannot be obtained which has the high grade roughness that is obtained by a lapping method. Furthermore, in a polishing method in which a disc type grindstone is employed, if the area to be machined is enlarged and the work is handed in a short time, great wear of the grindstone occurs, and a finished surface of satisfactory accuracy can not easily be obtained.

SUMMARY OF THE INVENTION

The polishing device according to the present invention is so constituted that it possesses, in a frame thereof, a rotary grindstone whose upper surface is a grinding surface, a device for holding a workpiece and pressing the same onto the grinding surface of the rotary grindstone, and a rotary type of truing dressing device in which the lower surface of a rotary grindstone for truing dressing is brought into contact with the grinding surfce of the rotary grindstone.

The polishing device according to the present invention is constituted by a frame; a rotary grindstone whose upper surface serves as a grinding surface, a rotary type of truing dressing device in which the lower surface of a rotary truing-dressing grindstone whose levelness can be adjusted is brought into contact with the grinding surface of the rotary grindstone; and a workpiece supplying and delivering device which intermittently moves a workpiece holding mechanism from a workpiece supplying position via the machining position above the rotary grindstone to a workpiece delivering position, the workpiece holding mechanism abutting the lower surface of the workpiece against the grinding surface of the above rotary grindstone with the lower surface of the workpiece being rotated, and a pressure adjusting machine which reduces grinding pressure on the workpiece in the final stage of the grinding work, and which is included in the workpiece holding mechanism.

Additionally, in the polishing device according to the prssent invention, a truing dressing device is mounted on a frame, the truing dressing device being constituted as follows: a rotary grindstone is journaled by a grindstone holder comprising an upper flange whose lower surface is a spherical seating portion and a lower flange having at the bottom surface thereof a plurality of adjusting bolts which upwardly penetrate the bottom surface. The grindstone holder is loosely inserted into an elevational bracket which is slightly moved upwardly or downwardly by means of feeder screws in an elavational device, the grindstone holder is supported in such a manner that the spherical seating portion thereof is engaged with a spherical holding seat which is formed at the top end of the elevational bracket. The lower end of the elevational bracket is brought into contact with the top surfaces of the adjusting bolts so that the levelness of the rotary grindstone is made adjustable.

The method of polishing according to the present invention is constituted in such a manner that with grinding work performed by means of rotation of a rotary grindstone, the rotry grindstone of the truing dressing device which is formed on the same frame is abutted against the rotary grindstone for the purpose of truing dressing the surface of the grinding surface of the rotary grindstone.

An object of the present invention is to provide a polishing device in which truing dressing of the grinding surface of a grindstone can be efficiently conducted, and which exhibits good yield and working rate, and in which the polishing work can be automated, and the costs of the device and its running costs can be significantly reduced.

Another object of the present invention is to provide a polishing device which can polish the workpiece n a short time with accuracy by setting grinding pressure at a high level in the first stage of the grinding process and setting the same at a low level in the final stage of the same.

A still further object of the present invention is to provide a polishing devcie in which adjustment of the levelness of a rotary grindstone and optional angular adjustment of the same can be easily conducted, the roary grindstone being adopted for truing dressing. Furthermore, the truing dressing of the rotary grindstone can be suitably conducted during grinding work so that the rotational grinding of the workpiece is accurately and efficiently conducted.

A still further object of the present invention is to provide a method of polishing in which an orfset wear or the like created on the grinding surface of the rotary grindstone is all times modified during the polishing work, whereby the workpiece can be effectively rotary-ground.

The other objects of the present invention will be understood through the description hereinafter.

DESCRIPTION OF THE PREFERRED EMBODIMENT

Figure 1:
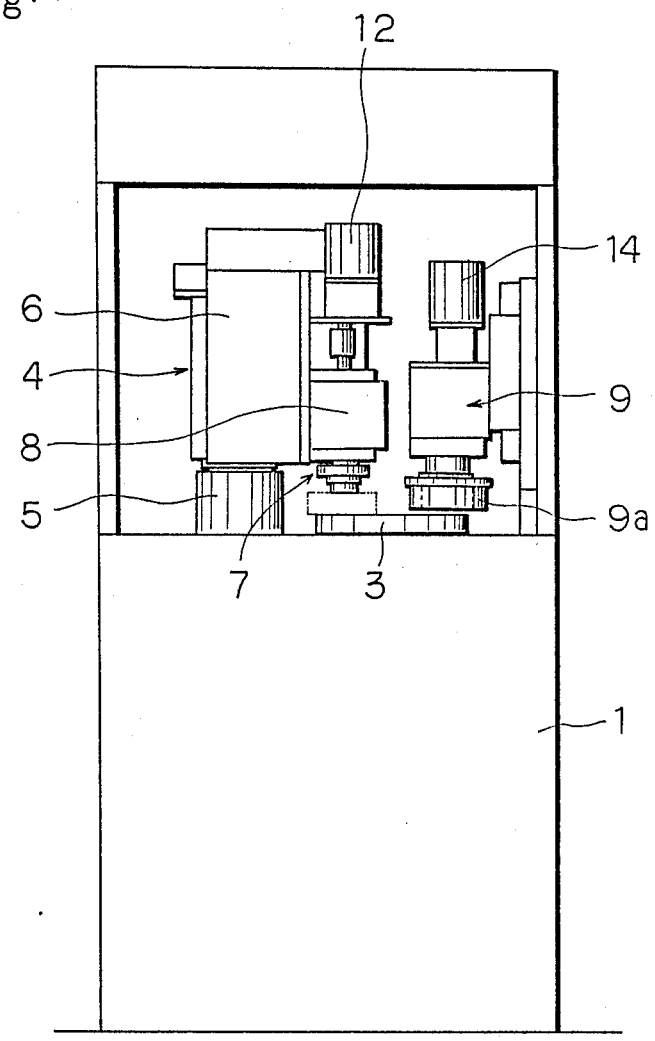
FIG. 1 is a side elevational view, from which parts are omitted, of a polishing device according to an embodiment of the present invention.
Figure 2:
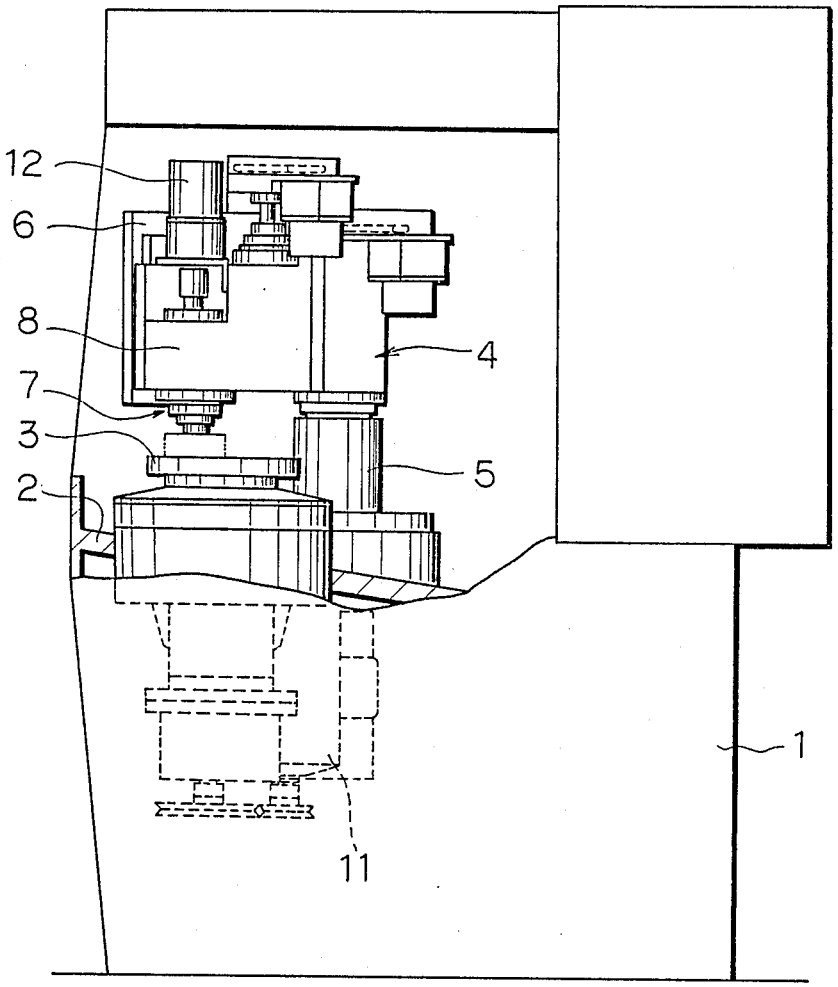
FIG. 2 is a side elevational view, from which parts are omitted, of the same.
Figure 3:
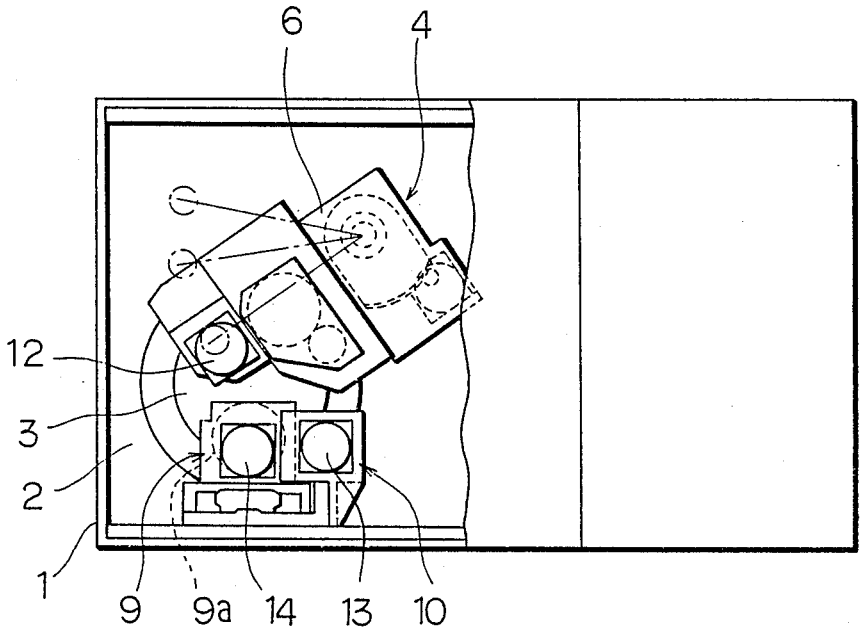
FIG. 3 is a plan view, from which parts are omitted, of the same.
Figure 4:
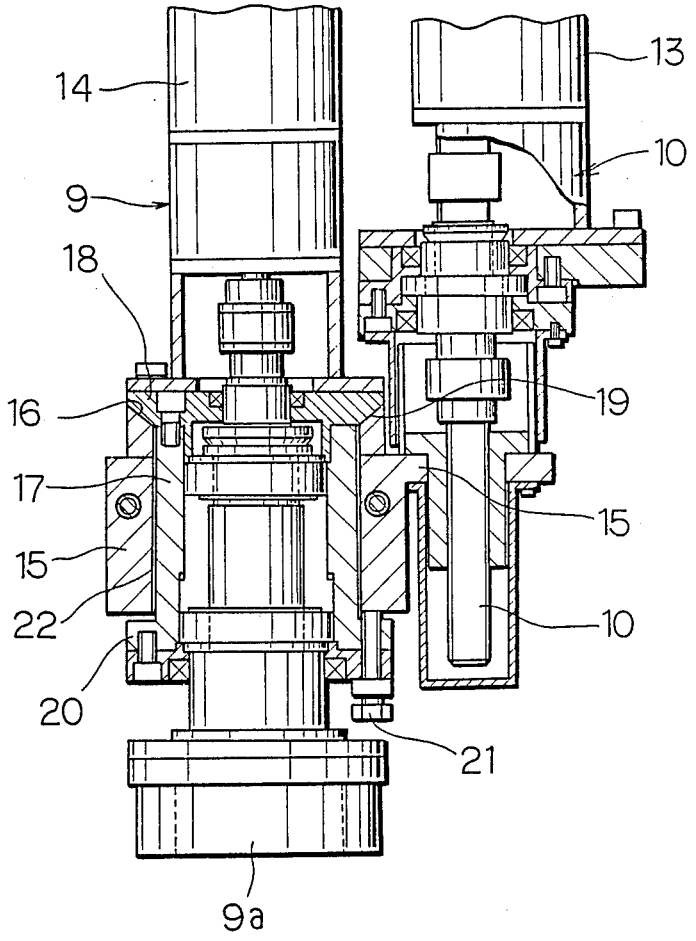
FIG. 4 is a side elevational view, from which parts are omitted, of a truing dressing device.
Figure 5:
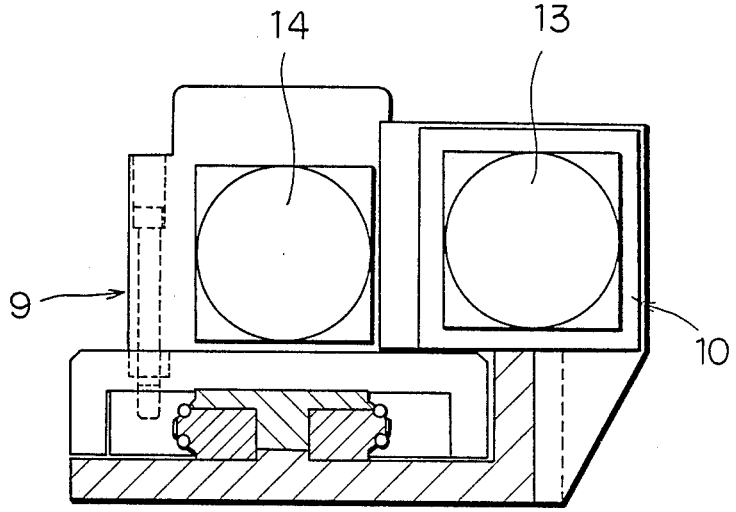
FIG. 5 is a plan view, from which parts are omitted, of a polishing device.

A polishing device according to an embodiment of the present invention will now be in detail described with reference to accompanying drawings. A rotary grindstone 3, which is made of, for example, a metal-bond grindstone using super abrasive grains such as cubic boron nitride or diamond, is mounted on the slanted top plate 2 of a box-shaped frame 1, the upper surface of the rotary grindstone 3 being grinding surface. A workpiece supplying and delivering device 4 is mounted on the frame 1 by means of a support column 5. A workpiece holding device 7 which rotates with the workpiece is mounted on a movable arm 6 of the workpiece supplying and delivering device 4, the movable arm 6 being able to move horizontally. The workpiece holding device 7 is arranged to intermittently move, by means of the workpiece supplying and delivering device 4, from a position at which the workpiece is supplied via a position above the rotary grindstone 3 to a position at which the workpiece is delivered, the workpiece being ground at the position above the rotary grindstone 3. A pressure adjusting device 8 is fitted to the workpiece holding device 7, the pressure adjusting device 8 acting to upwardly or downwardly move the workpiece holding device 7 for the purpose of changing the pressure in the intial state of the polishing work to that in the final stage of the same work. The workpiece is applied with a relatively higher pressure in the intial stage of the grinding process than that in the final stage of the same for the purpose of rough-machining the workpiece to approximate it to a predetermined size in a short time. In the final stage of the grinding work, the machining pressure is reduced for the purpose of conducting a precision finishing by which an accurate finish and accurate dimensions can be obtained. A truing dressing device 9 is fitted to a side wall of the frame 1 with an elevational device 10 in such a manner that a truing-dressing rotary grindstone **9*a* which is disposed at the lower end thereof confronts either side of the rotary grindstone 3, the truing dressing device 9 being able to move upwardly and downwardly. The levelness of the rotary grindstone 9*a* of the truing dressing device 9 is able to be adjusted for the purpose of horizontaly dressing the upper surface of the rotary grindstone 3, or conduct dressing the same in such a manner that the upper surface is shaped in the form of a ripple having a slanted surface. Furthermore, a motor 11 for rotating the rotary grindstone 3, a motor 12 for actuating the rotary workpiece-holding device 7, and motors 13 and 14 for moving upwardly and downwardly and rotating the rotary type of truing dressing device 9 are respectively provided. A mechanism for adjusting the levelness of the rotary grindstone 9*a* of the truing dressrng device 9 is, as shown in FIG. 4, constituted in such a manner that the upper end of an elevational bracket 15 which is moved upwardly and downwardly by a feeding screw 10*a* of an elevational device 10 is formed in a spherical holding seat 16. A grindstone holder 17 is supported in such a manner that a spherical seating portion 19 formed in an upper flange 18 of a grindstone holder 17 is brought into contact with the spherical holding seat 16, the grindstone holder 17 being inserted loosely into the elevational bracket 15 with a slight gap 22 remainted between the grindstone holder 17 and the elevational bracket 15. As a result of this, the above-described rotary grindstone 9*a* is journaled by the grindstone holder 17. Three adjusting bolts 21 are penetrated through the lower surface of a lower flange 20 of the grindstone holder 17, and each top end of the adjusting bolts 21 is positioned in contact with the lower surface of the above-described elevational bracket 15**.

In the device constituted as described above, the workpiece holding device 7 that is mounted on the movable arm 6 of the workpiece supplying and delivering device 4 mounted on the frame 1 is stopped by means of the movement of the movable arm 6, the workpiece holding device 7 being stopped at the position at which the workpiece is supplied and is held by the workpiece holding device 7. The workpiece holding device 7 is moved to and stopped at a position above the rotary grindstone 3, the workpiece being machined at this position. Then, the pressure adjusting device 8 of the workpiece holding device 7 is actuated so that the workpiece which is being rotated is brought into abutment with the rotary grindstone 3 with a predetermined pressure. When the grinding side of the rotary grindstone 3 is worn corresponding to the amount of grinding of the workpiece, the elevational bracket 15 is slightly moved downwardly by the actuation of the feeding screw **10*a* of the rotary type of truing dressing device 9 which is mounted above the frame 1 with the above grinding work being continued. As a result of this, the rotary grindstone 9*a* is moved downwardly with the grindstone holder 17, the grindstone holder 17 bein9 inserted loosely into the elevational bracket 15, the spherical seating portion 19 of the upper flange 18 of the grindstone holder 17 being supported by the spherical holding seat 16 of the elevational bracket 15, and each top end of the adjusting bolts 21 being positioned in abutment against the lower end of the elevational bracket 15. As a result of this, the lower end surface of the rotational grindstone 9*a* is brought into contact with the grinding side of the rotary grindstone 3, and the truing dressing is conducted. The levelness of the lower surface of the rotary grindstone 9*a* can be easily adjusted by way of adjusting the projection of the ajusting bolts 21 for the purpose of obtaining the level surface or a required angle because of the following reason: because the grindstone holder 17 is, as described above, loosely inserted into the elevational bracket 15, and the upper end of the same is supported by means of the spherical holding seat 16 and the spherical seating portion 19**.

Furthermore, in this embodiment, the workpiece can be machined at the above-described position in such a manner that the machining pressure is reduced by means of the above-described pressure adjustment device 8 in the final stage of the machining for the purpose of improving the accuracy of the finished surface and the dimensional accuracy of the workpiece, and conducting the final finishing without any necessity of changing the rotary grindstone 3. After the workpiece has been machined completely, the workpiece holding mechanism 7 is moved to the position at which the workpiece is delivered by the actuation of the movable arm 6 of the workpiece supplying and delivering device 4. Then the workpiece is removed from the workpiece holding device 4. The above-described cycle is allowed to be repeated.

As can clearly be seen from the above description, since this invention employs the rotary grindstone, dust which is generated in a lapping method does not generate, as a result of which, the work environment can be kept good condition. Furthermore, cleaning of the workpiece becomes needless, and the offset wear of the rotating side of the rotary grindstone is all times modified by the truing dressing device. Therefore, the grinding side can be applied with the truing dressing without any necessity of removing the rotary grindstone from the frame. Consequently the working efficiency and yield can be improved.

Furthermore, the machining pressure for the grinding work can be set at a high pressure in the initial stage of the grinding process, and it can be set at a low pressure in the final stage. Therefore, the workpiece can be ground to an approximate dimensions in a short time, and the accuracy of the finishing can be improved, causing another finishing to become needless.

Furthermore, since the levelness of the roary grindstone for truing dressing can be adjusted by a simple operation, the dimensional error caused from the mounting of the rotary grindstone can be absorbed. Furthermore, the grinding side of the rotary grindstone can be formed horizontally, as well as formed in a slanted cross section by means of dressing for the purpose of absorbing the lack in polishing generated in the central portion of the workpiece to be ground. To the contrary, the central portion of the workpiece to be ground can be shaped in a convex form. Furthermore, since truing dressing can be carried out during the grinding work, the operation rate can be raised to a maximum level, and the labor, time, and dimensional error, caused from the attaching of the rotary grindstone can be reduced.

Furthermore, since the truing dressing device is provided for a frame on which the rotary grindstone and the workpiece holding device are mounted, the size of the device can be kept compact. Furthermore, since the grinding side is all times modified, the whole body of the device is needless to be made precise device. Therefore, the device can be realized at a low cost. As a result of this, a grinding method and device can be realized in which the convetional problems can be overcome, the grinding work can be automated, and the running costs can be significantly reduced. Consequently, the present invention will contribute to the development of the field of this invention.

What is claimed is:

1. A polishing device comprising:

a frame;

a first rotary grindstone rotatably mounted on said frame, the upper surface of said rotary grindstone being a first grinding side;

a workpiece holding means for holding and bringing a workpiece into abutment with said first grinding side of said first rotary grindstone;

a pressure adjusting means incorporated in said workpiece holding means for adjusting the grinding pressure upon said workpiece; and a truing dressing means for dressing said first grinding side of said first rotary grindstone, said truing dressing means having a second rotary grindstone and an angle adjust means for adjusting and fixing the angle of said second rotary grindstone with respect to said upper surface of said first rotary grindstone.

2. The polishing device according to claim 1, wherein said truing dressing means comprising:

a vertically movable elevational bracket having a first spherical holding seat at substantially at the top end thereof;

a grindstone holder for holding said second rotary grindstone, said grindstone holder being provided with a second spherical holding seat engaging with said first spherical holding seat; and a plurality of adjusting bolts provided upon said grindstone holder for supporting said elevational bbracket in a manner such that the angle of said second rotary grindstone can be adjusted and fixed with respect to said upper surface of said first rotary grindstone.

3. The polishing device according to claim 1, wherein said workpiece holding means further has a workpiece supplying and delivering means for supplying said workpiece to and delivering said workpiece from the position of said first rotary grindstone.

4. The polishing device according to claim 3, wherein said workpiece supplying and delivering means further has a movable arm for moving said workpiece holding means to take either a first position where said workpiece is supplied or delivered or a second position where said workpiece is ground by said first rotary grindstone.

* * * * *